United States Patent [19]

Manlow

[11] Patent Number: 4,594,025

[45] Date of Patent: Jun. 10, 1986

[54] TUNNELLING AND TUNNEL RELINING EQUIPMENT

[75] Inventor: Terence V. Manlow, Camberley, England

[73] Assignee: Rees Construction Services Limited, Old Woking, England

[21] Appl. No.: 623,985

[22] Filed: Jun. 25, 1984

[30] Foreign Application Priority Data

Jun. 27, 1983 [GB] United Kingdom ..... 8317347

[51] Int. Cl.[4] ..... E01G 5/04; E21D 11/00

[52] U.S. Cl. ..... 405/147; 405/138; 405/146

[58] Field of Search ..... 405/146, 147, 138, 139, 405/140, 150, 151; 299/31, 32, 33

[56] References Cited

U.S. PATENT DOCUMENTS

| | | | |
|---|---|---|---|
| 515,016 | 2/1894 | Ransome | 405/146 X |
| 549,586 | 11/1895 | Rothwell | 405/146 X |
| 3,494,136 | 2/1970 | Wilms | 405/147 |
| 3,561,223 | 2/1971 | Tabor | 405/146 X |
| 3,640,076 | 2/1972 | Rees et al. | 405/146 |

FOREIGN PATENT DOCUMENTS

| | | | |
|---|---|---|---|
| 1163356 | 2/1958 | France | 405/146 |
| 482875 | 1/1970 | Switzerland | 405/146 |
| 1554222 | 10/1979 | United Kingdom | 405/146 |

*Primary Examiner*—Dennis L. Taylor
*Attorney, Agent, or Firm*—Ladas & Parry

[57] ABSTRACT

A method of constructing a lined or relined tunnel utilizes four lining segments, three of which (1, 2, 3) have a longer arcuate length than the fourth (4). The tunnel is constructed within a shield (20) having a tubular member (21) and a curved build plate (22) having a minimum internal dimension at least the same as the outside radius of the lining. The shield also has a circular skirt (25) the upper part of which is extended rearwardly to form a hood (26). In the method a length of tunnel is excavated and the shield positioned therein, a first segment (1) is positioned on the build plate and the segments (2, 3) then located upon the first segment (1). The ends of the second and third segments (2, 3) remote from the segment (1) are pivoted outwardly to locate the fourth segment (4). The shield is provided with a flexible collar (27) extending from the confluence of the member (21) and skirt (25) interiorly of the shield to provide a seal between the lining segments and the collar against filler material (40), the collar having an L-shape for clampingly securing the collar to the tubular member and skirt combination.

12 Claims, 6 Drawing Figures

TUNNELLING AND TUNNEL RELINING EQUIPMENT

This invention relates to tunnelling and tunnel relining equipment and in particular to a shield used in constructing a lined or relined tunnel and to a method of utilising the shield in producing a lined or relined tunnel.

It is known from G.B. Pat. No. 1,288,393 that a lined tunnel is made from three adjoining lining segments each extending through an arc of 120° so as to form a toroid and that the segments are intially erected in a shield which is arranged to advance with excavation of the tunnel. The lined tunnel is thus formed from a plurality of lining toroids.

Although the tunnelling equipment and arrangement of segments disclosed in G.B. Pat. No. 1,288,393 is adequate for tunnels having a bore of 1220 mm or less it has been found that with larger diameter tunnels, for example up to 3 meters, the arrangement of utilising only three segments requires a shield having an internal diameter which is much greater than the outside diameter of the final lining toroid because in erecting the segments of the toroid the segment which is the second to be positioned is required to be pivoted outwardly in order that the third segment may be positioned. Because segments increase in thickness with increasing diameter, to provide the necessary strength of lining, so the internal diameter of the shield is required to increase. Such an increase in diameter of the shield necessitates not only excavating a tunnel of greater diameter but that the distance between the shield and lining which is required to be filled with grouting also increases. It will be appreciated that this leads to a considerable increase in tunnelling cost.

The present invention seeks to provide a method of constructing a tunnel and tunnelling equipment in which the foregoing increase in cost is reduced.

According to a first aspect of this invention there is provided a method of constructing a lined or relined tunnel utilising four lining segments, three of said segments having a greater arcuate length than the fourth, and a shield comprising a tubular member, a curved build plate located inside the forward end of said tubular member, the build plate having a minimum internal dimension at least the same as the outside radius of the lining, a substantially circular skirt projecting from a rear end of said tubular member and having substantially the same diameter as said tubular member, said skirt having a rearwardly extended hood disposed about an arc encompassing the upper curved part of the tubular member, including the steps of:

(a) providing a length of a tunnel within said shield which shield is arranged to have an internal diameter greater than the outside diameter of the erected lining,
(b) positioning a first segment of long length on the build plate,
(c) engaging one end of a second segment of long length to one end of the first segment,
(d) engaging one end of a third segment of long length to the other end of the first segment,
(e) raising the other ends of the second and third segments by pivoting the one ends thereof so as to locate therebetween the fourth segment, whereby a toroid is formed.

Preferably the further steps are provided of:

(f) urging the thus formed toroid rearwardly to join with the previously erected lining,
(g) advancing the shield such that a major length of the newly formed toroid is below said hood,
(h) filling the space rearward of a collar of the skirt between the lining and the shield or excavated tunnel under pressure with filler material,
(i) advancing the shield and repeating the steps of a–h.

In a preferred embodiment the first and second segments each extend through an arc of 120° and said fourth segment extends through an arc which is less than that of said third segment, said third and fourth segments together extending through an arc of 120°.

Where a tunnel is being formed the step (a) of providing a length of tunnel is performed by excavation.

Advantageously the second, third and fourth segments of adjacent toroids are disposed on opposing sides of a vertical axis through said toroid whereby tolerancing errors in the length of the segments are accommodated.

The filler material may be single size pea shingle preferably selected from a mesh size in the range 6–10 mm. The pressure under which the shingle is fed is preferably 517 kPa.

In a currently preferred embodiment the segment is positioned by rotatably mounting a segment of long length on a leading end of a skip provided for removing excavated material, longitudinally positioning said segment in said tunnel by positioning said skip, radially positioning said segment to be at a required radius for said tunnel, circumferentially rotating said segment into a desired location, demounting said segment from said skip, and removing said skip from the tunnel.

Advantageously the skip transports excavated material from the tunnel when it is removed therefrom.

Conveniently the segment is mounted on the skip by retractable pins predeterminedly locating in radial holes through which the filler material is to be introduced.

Preferably the segment is radially and subsequently circumferentially positioned by activation of rams.

According to a second aspect of this invention there is provided a shield for assembly of tunnel segments within an excavated tunnel comprising a tubular member, a curved build plate located inside a forward end of said tubular member for supporting lining segments, the build plate having a larger internal dimension than the outside radius of the lining, a substantially circular skirt projecting from a rear end of said tubular member and having substantially the same diameter as said tubular member, said skirt having a rearwardly extended hood portion disposed about an arc incorporating the upper curved part of the tubular member for protecting at least the last assembled lining segment from the excavated tunnel roof, and a flexible collar extending from the confluence of the tubular member and the skirt interiorally of the shield such that in operation a seal is formed between the lining segments and said collar, the collar having an L-shaped foot for clampingly securing said collar to the tubular member and skirt combination.

Preferably there is provided a clamping ring having substantially the same internal dimension as the build plate, said clamping ring being secured to the inside surface of the tubular member and overlapping the rear end thereof and the foot of the collar, and a fixing means directed radially through the clamping ring and the skirt for clamping said foot between the clamping ring and the skirt.

Advantageously the build plate extends through an arc in the range 120°–220° and preferably 146°. Conveniently the build plate is evenly positioned in the shield.

The invention will now be described by way of example with reference to the accompanying drawings in which.

In the figures like reference numerals denote like parts.

Figure 1:
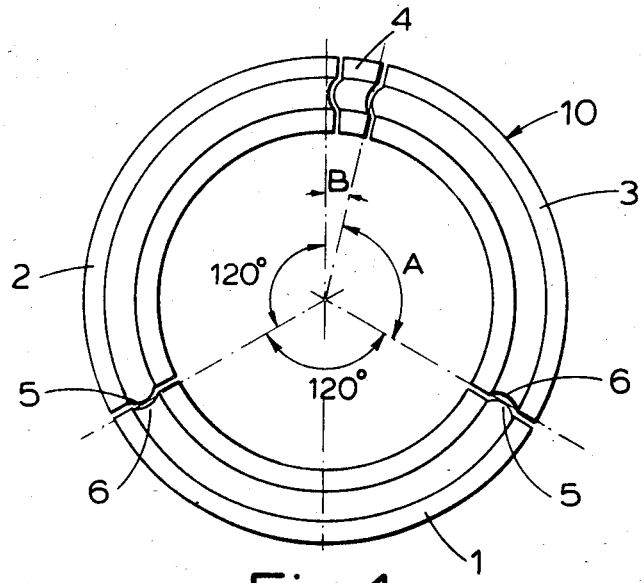
FIG. 1 shows an end view of the lining segments used in this invention.

A lining toroid 10 shown in FIG. 1 has first, second, third and fourth segments 1, 2, 3, 4 respectively, the first and second segments extending through an arc of 120°, the third segment extending through an angle A in the range 110–112.1/2° and the fourth segment extending through an angle B in the range 10°–7.5°, the third and fourth segments in combination extending through an arc of 120°. The arc through which the fourth segment extends decreases with increasing diameter of the tunnel lining and the foregoing angles of arc are for linings having internal diameters 1500 mm–2200 mm. Each segment has a male end 5 and an opposing female end 6, adjacent male and female ends of the segments being arranged to interlock.

Figure 2:
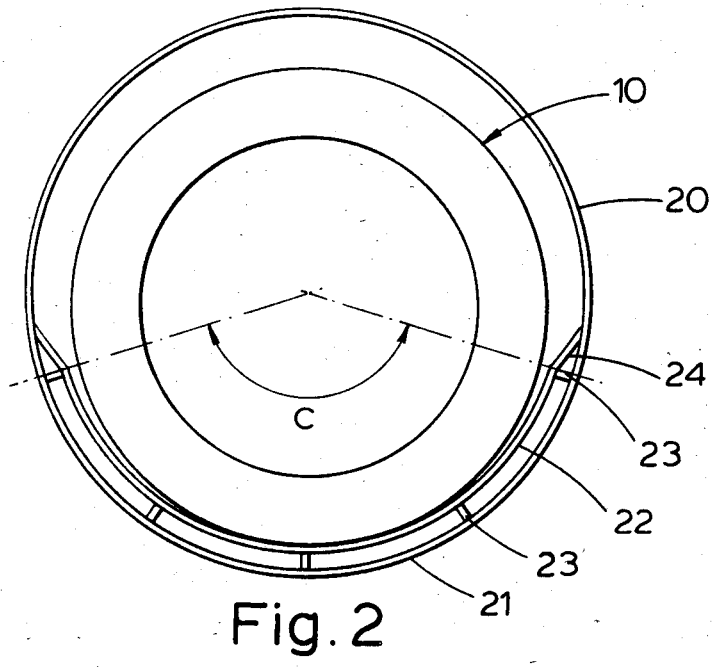
FIG. 2 shows an end view of the tunnelling equipment in accordance with this invention.
Figure 3:
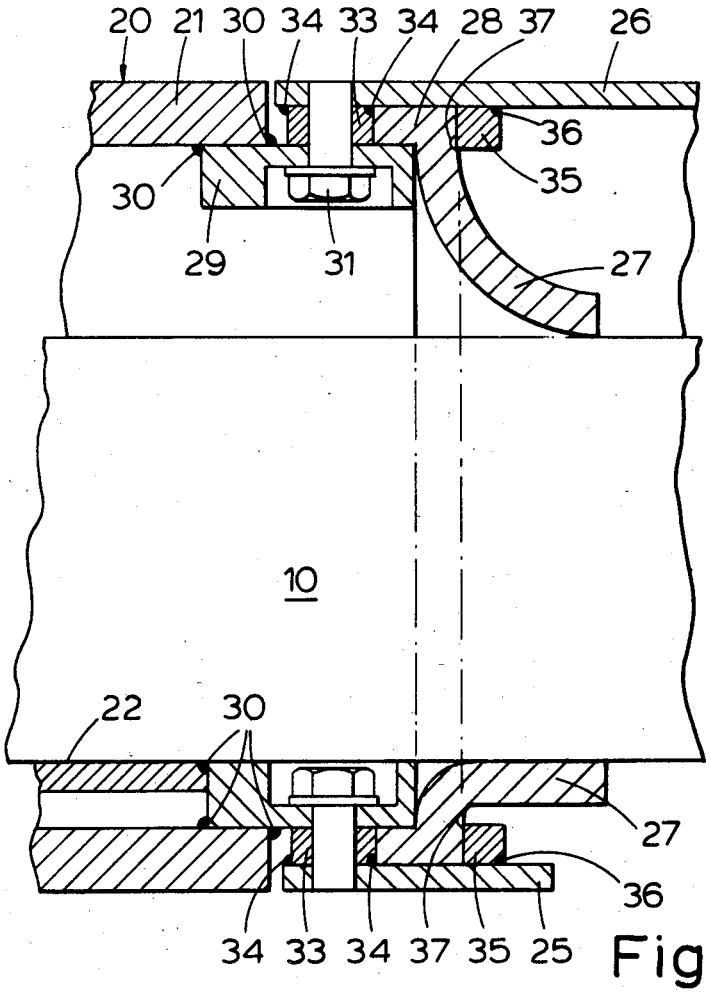
FIG. 3 shows a part, vertical cross-section through the tunnelling equipment of this invention.

As shown in FIGS. 2 and 3 a shield 20 has a greater internal diameter than the external diameter of the toroidal lining 10 and the shield is formed by a tubular member 21. Within a forward end of the tubular member is evenly disposed a curved build plate 22 of near parabolic shape having a minimum radius substantially the same as the radius of curvature of the tubular member 21. The build plate 22 extends through an angle C in the range 120°–220° and preferably 146°. It is to be noted that the internal radial dimension of the build plate is arranged to be, in general, larger than that of the external radius of the toroid 10 and is chosen to permit the segment 1 positioned thereon to be able to move without too much friction and yet to present sufficient friction to prevent the segment 1 from sliding when segment 2 is joined therewith. As will be seen from FIG. 2 the build plate 22 is supported inside the tubular member 21 by circumferentially disposed spacers 23. For safety and for ease of location of the segments the remote ends 24 of the build plate are angled outwardly to abut the interior walls of the tubular member 21.

The shield also comprises a rearwardly extending short length tubular skirt 25, the upper portion of which is extended rearwardly to form a hood 26 which is disposed about an arc encompassing the upper curved part of the tubular member and having a length sufficient to protect at least the last assembled lining segments from the excavated roof tunnel when filler material is provided. A flexible rubber collar 27 having an L-shaped foot 28 which is secured by a clamping ring 29 is provided at the confluence between the tubular member 21 and skirt 25. The collar 27 is arranged to extend inwardly a distance at least sufficient to be abutted by the toroidal tunnel linings. The clamping ring 29 is welded to the tubular member 21 and build plate 22 as indicated by welds 30. Fixings constituted by bolts 31 located in a recess 32 of the clamping plate are threadably engaged into corresponding nuts 33 which nuts are welded to the skirt 25 by welds 34. A buffer ring 35 is welded by welds 36 on the opposite side of the foot 28 from the clamping ring 29 so that the foot 28 is sandwiched between the nuts 34 and the buffer ring 35. So as to assist in maintaining the position of the collar 27 a projecting dowel 37 is provided on the side of the buffer ring 35 adjacent the collar 27.

Figure 4:
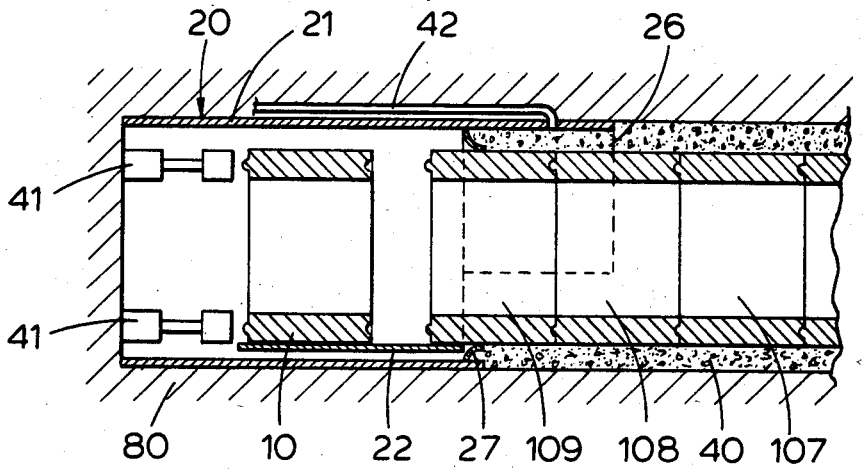
FIGS. 4 and 5 show the tunneling equipment of this invention at different stages in constructing a lined tunnel.

Referring now to FIG. 4, a vertical cross-section through an excavated tunnel is shown in which toroid linings 107, 108, 109 have already been positionally joined and single size pea shingle 40 selected from a mesh size in the range 6–10 mm has been used to fill the void between the excavated tunnel 80 and the toroid linings 107–109, the shingle 40 being prevented from movement in a forward direction by the collar 27.

In the FIG. 4 a length of tunnel has been excavated and segment 1 has been positioned on the build plate 22, segments 2 and 3 have been joined to segment 1 and both segments 2 and 3 pivotted outwardly about the ends thereof which adjoin with segment 1 so as to allow the insertion of segment 4 between the ends of segments 2 and 3 remote from segment 1. It will be appreciated that because segment 4 is relatively short in arcuate length in relation to the remaining segments so it is not necessary for segments 2 and 3 to be moved outwardly from their final positions by an undue amount so that the inside diameter of the shield is reduced in comparison with the construction shown in G.B. Pat. No. 1,288,393 where only three segments of equal arcuate length are employed.

Having constructed a toroid lining 10 on the build plate 22 the toroid 10 is urged rearwardly by rams 41 such that the newly formed toroid 10 adjoins the earlier constructed toroid 109 to thereby form a continuous lining of toroids 107, 108, 109 and 10. Continued pressure exerted by the rams 41 upon the toroid 10 is then used to advance the shield 20 forwardly to a position where a major length of the newly formed toroid 10 is beneath the hood. Shingle 40 is then injected at a pressure of 517 kPa through a pipe 42 and holes 43 in the periphery of the toroid until the space rearwardly of the collar between the lining and the shield or excavated tunnel is filled with single so as to provide continuous ground support for the lining, an even distribution of earth loads to the lining and a good material foundation for the injection of waterproofing grout. In this latter respect the holes 43 in each toroid are filled with grout and preferably there are three equally spaced holes 43 in each toroid. Additionally in the formation of the toroid, sealing tape may be placed in all longitudinal and circumferential joints.

Figure 5:
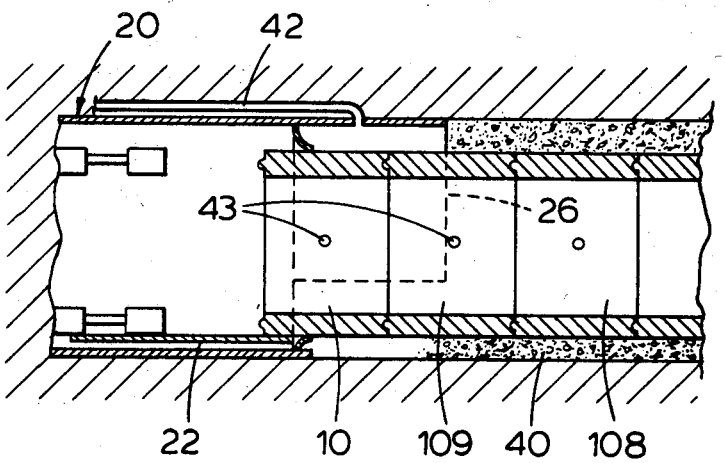

The collar 27 prevents the pressurised shingle from travelling forwardly into the toroid constructing area of the shield and the particular construction of collar employed facilitates a minimum gap to be utilised between the tunnel lining and internal diameter of the shield. The hood 26 it will be noted from FIG. 5 provides support from the overburden prior to and whilst the shingle 40 is being injected.

Figure 6:
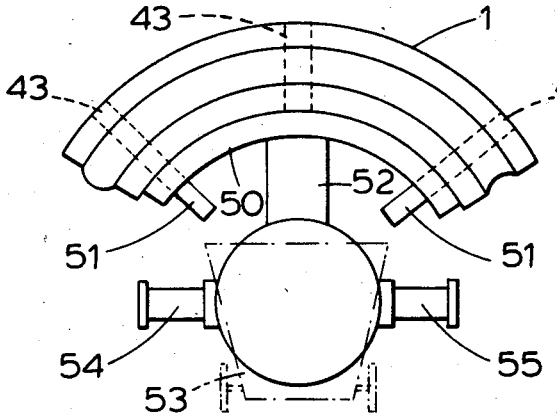
FIG. 6 shows a segment erecting apparatus.

An end view of a currently preferred apparatus for erecting one of the longer segments in the tunnel will now be described with reference to FIG. 6. The segment 1 is mounted on an arcuate arm 50 having substantially the same external radius of curvature as the internal radius of curvature of the segments. The sgment 1 is maintained in position on the arm 50 by retractable pins 51 (shown in their retracted position in FIG. 6) which are insertable into the grout holes 43 of the segment. The arm 50 is mounted on a reciprocatable hydraulic ram 52. The ram 52 is rotatably located on a leading end of a wheeled skip 53 provided for removing excavated material. Provided to extend perpendicularly outwardly from a vertical plane extending longitudinally through the skip is a further hydraulic ram having pistons 54, 55, which pistons are arranged to act upon a chain (not shown) provided for rotating the ram 52. By using ram pistons 54, 55 acting on a chain a large rotational effort is produced in a confined space. In operation of the segment erecting apparatus the skip is positioned at the correct longitudinal position in the tunnel for the next segment to be erected and the ram 52 is activated to raise the segment into the desired radial position and the ram 52, arm 50 and segment combination is rotated into the desired circumferential position by activation of a desired one of pistons 54 or 55, the segment being retained in position on the arm 50 by virtue of the pins 51. The pins 51 are then withdrawn from the segment and the skip is withdrawn from the tunnel and transports excavated material. It would thus be understood that by utilising the apparatus above described for erecting tunnel segments a saving in time and construction cost is produced by utilising the skip not only for transporting excavated material but also to transport segments to the desired construction position.

The steps of excavating and erecting segments is then repeated.

In a practical embodiment of the invention toroidal linings having an internal diameter of 1000–1300 mm are 60 cm long and toroidal segments having an internal diameter of 1500–3000 mm have a length of 75 cm.

By utilising a fourth segment having an arcuate length much less than the length of the second and third segments, for a 1500 mm internal diameter tunnel lining, a saving of 10% on excavation costs is produced and a saving of 50% on shingle filling and grouting costs is effected. Whereas with the construction described in G.B. Pat. No. 1,288,393 a shield of 1880 mm O/D was required, this has now been reduced to 1800 mm by utilising four segments as described herein. The savings in cost in constructing a tunnel as described herein. The savings in cost in constructing a tunnel as described herein has thus been quite considerable.

Although the invention has been described in connection with forming a lined tunnel it is to be understood that the invention is also applicable to relining an existing lined tunnel in which the excavation step is omitted. It is also to be understood that it is not essential for the method of the invention to require first and second segments of equal length and in this respect the length of all the four segments may differ but the greatest saving in cost provided by the method of the invention is to provide a fourth segment having a shorter arcuate length than the other segments.

It will be realised by those skilled in the art that instead of pea shingle, as described, other suitable filler materials may be used, such as cement grout, fly ash etc.

I claim:

1. A method of constructing a lined or relined tunnel utilising four lining segments, three of said segments having a greater arcuate length than the fourth, and a shield comprising a tubular member, an integral bottom, curved build plate located inside the forward end of said tubular member, the build plate having a minimum internal dimension at least the same as the outside radius of the lining, a substantially circular skirt projecting from a rear end of said tubular member and having substantially the same diameter as said tubular member, said skirt having a rearwardly extended hood disposed about an arc encompassing the upper curved part of the tubular member and a radially inwardly directed collar for sealing by engaging with the outer periphery of the erected lining, including the steps of:

(a) providing a length of a tunnel within said shield which shield is arranged to have an internal diameter greater than the outside diameter of the erected lining, (b) positioning a first segment of long length on the build plate, (c) engaging one end of a second segment of long length to one end of the first segment, (d) engaging one end of a third segment of long length to the other end of the first segment, (e) raising the other ends of the second and third segments by pivoting the one ends thereof so as to locate therebetween the fourth segment, whereby a toroid is formed, (f) urging the thus formed toroid rearwardly to join with the previously erected lining, (g) advancing the shield such that a major length of the newly formed toroid is below said hood, (h) filling the space rearward of a collar of the skirt between the lining and the shield or excavated tunnel under pressure with filler material, (i) advancing the shield and repeating the steps of a–h.

2. A method as claimed in claim 1 wherein the first and second segments each extend through an arc of 120° and said fourth segment extends through an arc which is less than that of said third segment, said third and fourth segments together extending through an arc of 120°.

3. A method as claimed in claim 1 wherein the second, third and fourth segments of adjacent toroids are disposed on opposing sides of a vertical axis through said toroid whereby tolerancing errors in the length of the segments are accommodated.

4. A method as claimed in claim 1 wherein the filler material is single size pea shingle.

5. A method as claimed in claim 5 wherein the shingle is selected from a mesh size in the range 6–10 mm.

6. A method as claimed in any of claims 1 to 6 wherein the pressure under which the shingle is fed is 517 kPa.

7. A method as claimed in claim 1 wherein means for rotatably and radially manoeuvering individual segments is mounted on a leading end of a skip provided for removing excavated material and the segment is positioned by rotatably mounting a segment of long length on said manoeuvering means, longitudinally positioning said segment in said tunnel by positioning said skip, radially positioning said segment to be at a required radius for said tunnel, circumferentially rotating said segment into a desired location, demounting said segment from said skip, and removing said skip from the tunnel.

8. A method as claimed in claim 7 wherein the skip transports excavated material from the tunnel when it is removed therefrom.

9. A method as claimed in claim 7 wherein the segment is mounted on the skip manoeuvering means by retractable pins in said manoeuvering means predeterminedly locating in radial holes through which the filler material is to be introduced.

10. A method as claimed in claim 7 wherein the manoeuvering means includes rams and the segment is radially and subsequently circumferentially positioned by activation of said rams.

11. A shield for assembly of tunnel lining segments within an excavated tunnel comprising a tubular member, an integral bottom, curved build plate located inside a forward end of said tubular member for supporting lining segments, the build plate having a larger internal dimension than the outside radius of the lining, a substantially circular skirt projecting from a rear end of said tubular member and having substantially the same diameter as said tubular member, said skirt having a rearwardly extended hood portion disposed about an arc incorporation the upper curved part of the tubular member for protecting at least the last assembled lining segment from the excavated tunnel roof, and a flexible collar extending from the confluence of the tubular member and the skirt interiorally of the shield, said collar being directed radially inwardly for providing a seal between the lining segments and said collar, the collar having an L-shaped foot for clampingly securing said collar to the tubular member and skirt combination.

12. A shield as claimed in claim 11 wherein there is provided a clamping ring having substantially the same internal radius as the build plate, said clamping ring being secured to the inside surface of the tubular member and overlapping the rear end thereof and the foot of the collar, and a fixing means directed radially through the clamping ring and the skirt for clamping said foot between the clamping ring and the skirt.

* * * * *